United States Patent [19]

Stoll

[11] 4,410,776

[45] Oct. 18, 1983

[54] CONTROL DEVICE

[75] Inventor: Donald H. Stoll, Morrison, Ill.

[73] Assignee: General Electric Company, Fort Wayne, Ind.

[21] Appl. No.: 244,021

[22] Filed: Mar. 16, 1981

[51] Int. Cl.[3] ..... H01H 35/34

[52] U.S. Cl. ..... 200/83 P; 200/67 DA; 200/83 S

[58] Field of Search ..... 200/81 R, 83 R, 83 P, 200/83 S, 83 SA, 159 B, 67 R, 67 D, 67 DA, 249-251, 283, 286

[56] References Cited

U.S. PATENT DOCUMENTS

| | | | |
|---|---|---|---|
| 2,755,362 | 7/1956 | Jacobs | 200/83 P |
| 3,984,650 | 10/1976 | Budlane | 200/83 P |
| 4,091,249 | 5/1978 | Huffman | 200/83 P |
| 4,214,136 | 7/1980 | Rossi | 200/67 DA |
| 4,220,836 | 9/1980 | Hersey | 200/83 P |
| 4,224,488 | 9/1980 | Rossi | 200/67 A |
| 4,328,406 | 5/1982 | Evans | 200/83 P |

FOREIGN PATENT DOCUMENTS

| | | | |
|---|---|---|---|
| 2020908 | 11/1979 | United Kingdom | 200/83 P |

*Primary Examiner*—G. P. Tollin

*Attorney, Agent, or Firm*—Joseph E. Papin

[57] ABSTRACT

A control device has a housing with a chamber therein, and a pair of means is mounted to the housing within the chamber for supporting a first contact and a switch having a resilient switch blade with a second contact engaged with the first contact. The supporting means include at least one deformable section, and a pair of adjusting means are adjustably movable in the housing to affect the deformations of the at least one deformable sections of the supporting means thereby to locate the first contact in an adjusted position defining a force required to break the first and second contacts upon actuation of the switch and to bias the switch blade toward another adjusted position defining another force required to remake the first and second contacts upon the actuation of the switch.

14 Claims, 4 Drawing Figures

CONTROL DEVICE

FIELD OF THE INVENTION

This invention relates in general to controls which may be utilized in an automotive type air conditioning system or the like for instance and in particular to a control device for the system.

BACKGROUND OF THE INVENTION

In the past, various different types of prior art control device, such as fluid pressure actuated switches for instance, were utilized in an automotive type air conditioning system to control the energization and deenergization of a clutch actuated compressor in such system in response to a low and high value of fluid pressure measured at a preselected point in such system, such as in an accumulator of such system for instance.

In some of these prior art control devices, a snap disc or Belleville type snap washer or the like for instance was utilized to effect the closing and opening of an electrical switch associated therewith in order to control the energization and deenergization of the clutch actuated compressor. The snap disc was translated from a stable configuration to an unstable configuration thereof in response to the occurrence of the aforementioned high value of the fluid pressure measured in the system, and in the unstable configuration, the snap disc drove a switch closed to complete a circuit energizing the clutch actuated compressor. Of course, the snap disc returned from its unstable configuration to its stable configuration in response to the occurrence of the aforementioned low value of the fluid pressure measured in the system, and the return of the snap disc to its stable configuration permitted the switch to open which interrupted the circuit effecting the deenergization of the clutch actuated compressor. Typically, a snap disc will translate between its stable and unstable configuration in response to a force differential which is built-in or preselected during the formation of the snap disc, and in at least some of these prior art control devices, the switch thereof may be adjustably loaded by a spring or the like in order to preselect the value of the force required for the snap disc to close the switch in response to the occurrence of the aforementioned high value of the fluid pressure measured in the system. However, at least one of the disadvantageous or undesirable features of the prior art control devices discussed above is believed to be that the "built-in" force differential of the snap disc is constant and can not be varied or adjusted. Further, it is also believed that the mechanical life of a snap disc may be limited due to the relatively high stresses which occur during the translatory movement of the snap disc between its stable and unstable configurations.

SUMMARY OF THE INVENTION

Among the several objects of the present invention may be noted the provision of an improved control device which overcomes the above discussed disadvantageous or undesirable features, as well as others, with respect to the prior art; the provision of such improved control device utilizing a switch actuated between a pair of electrical states and having adjusting means for adjusting the force required to effect the actuation of the switch from one of the electrical states to the other thereof and for adjusting a force differential between such required force and another force required to effect the return of such switch to the one electrical state thereof; the provision of such improved control device utilizing a pair of means for supporting the switch and contact means for making with the switch and breaking therefrom with the supporting means each having at least one deformable section which are deformable so as to define the aforementioned required force and force differential, respectively; and the provision of such improved control device utilizing components which are simplistic in design, easily assembled and economically manufactured. These as well as other objects and advantageous features of the present invention will be in part apparent and in part pointed out hereinafter.

In general and in one form of the invention, a control device is provided with a housing having a chamber therein, and contact means is adapted for adjustable disposition in an adjusted position within the chamber. Means mounted to the housing for supporting the contact means includes means associated with the contact means within the chamber and adapted for permanent deformation and means exteriorly of the chamber adapted for electrical connection. Switch means adapted for adjustable disposition in another adjusted position in the chamber is operable generally for making with the contact means and breaking therefrom, and another means mounted to the housing within the chamber for supporting the switch means includes at least another means adapted for permanent deformation. Condition responsive means is movable in the housing upon the occurrence of a preselected condition for effecting the operation of the switch means. Means is adjustably movable in the housing and engaged with the first named supporting means within the chamber for exerting an adjusting force thereon to permanently deform the first named permanent deformation means and effect the adjustable disposition of the contact means in the first named adjusted position thereof. Another means is adjustably movable in the housing and engaged with the another supporting means within the chamber for exerting another adjusting force thereon to permanently deform the at least another permanent deformation means and effect the adjustable disposition of the switch means in the another adjusted position thereof.

BRIEF DESCRIPTION OF THE DRAWINGS

Corresponding reference characters indicate corresponding parts throughout the several views of the drawings.

The exemplifications set out herein illustrate a preferred embodiment of the present invention in one form thereof, and such exemplifications are not to be construed as limiting in any manner the scope of the present invention or the disclosure thereof.

DETAILED DESCRIPTION OF THE PREFERRED EMBODIMENT

Figure 1:
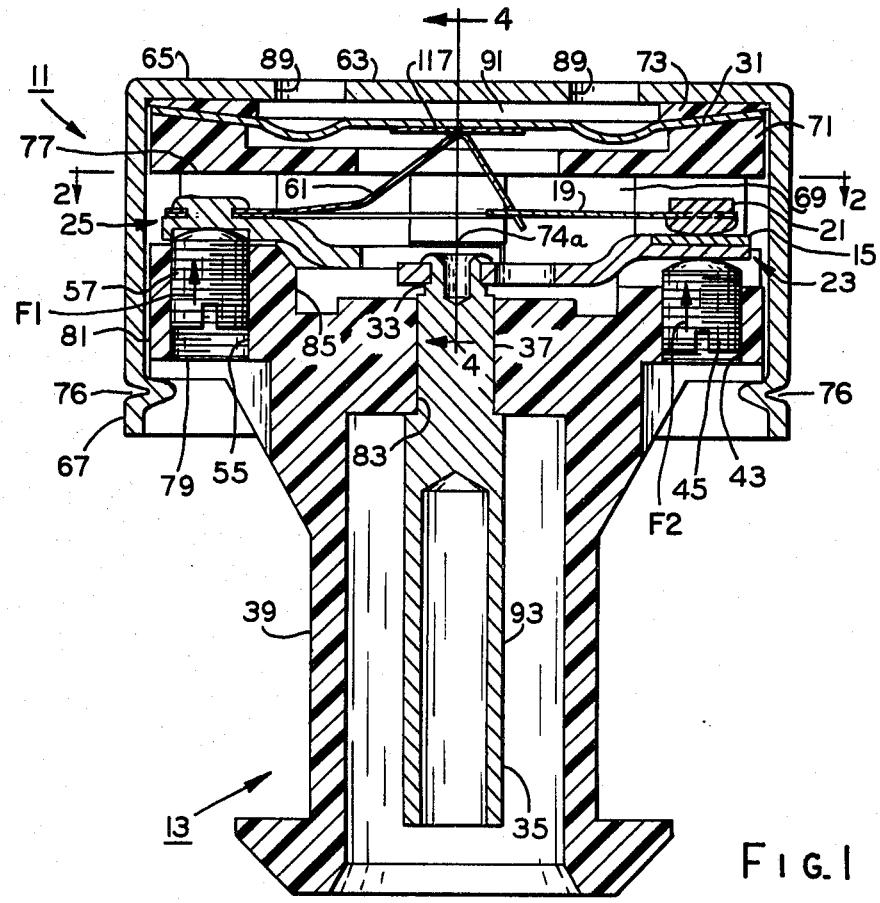
FIG. 1 is a sectional view showing a control device in one form of the invention in cross-section and illustrating principles which may be utilized to practice a method of assembling a control device.
Figure 2:
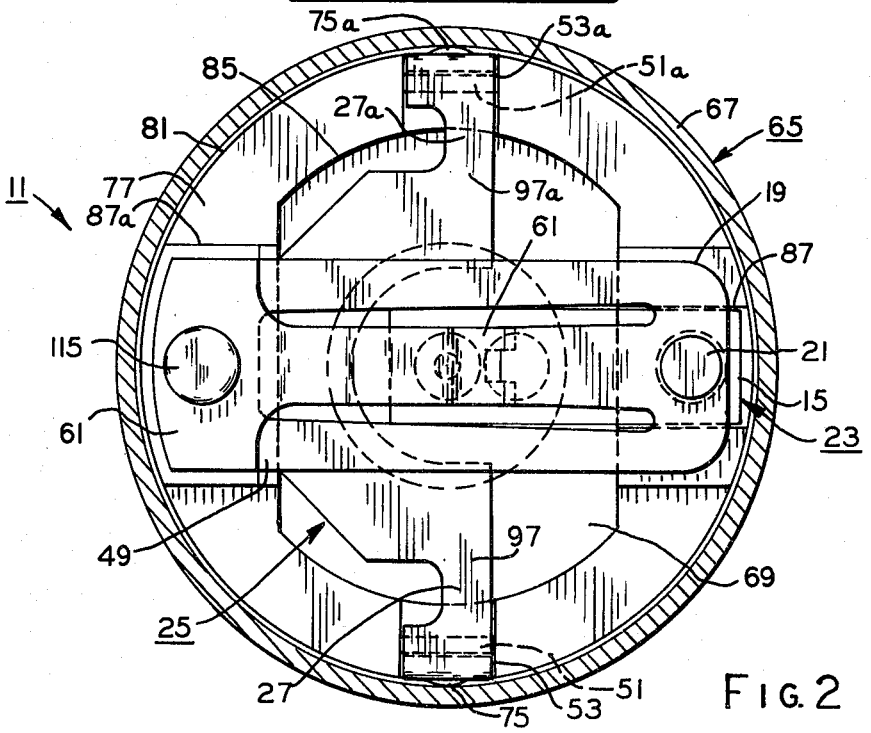
FIG. 2 is a sectional view taken along line 2—2 of FIG. 1.
Figure 3:
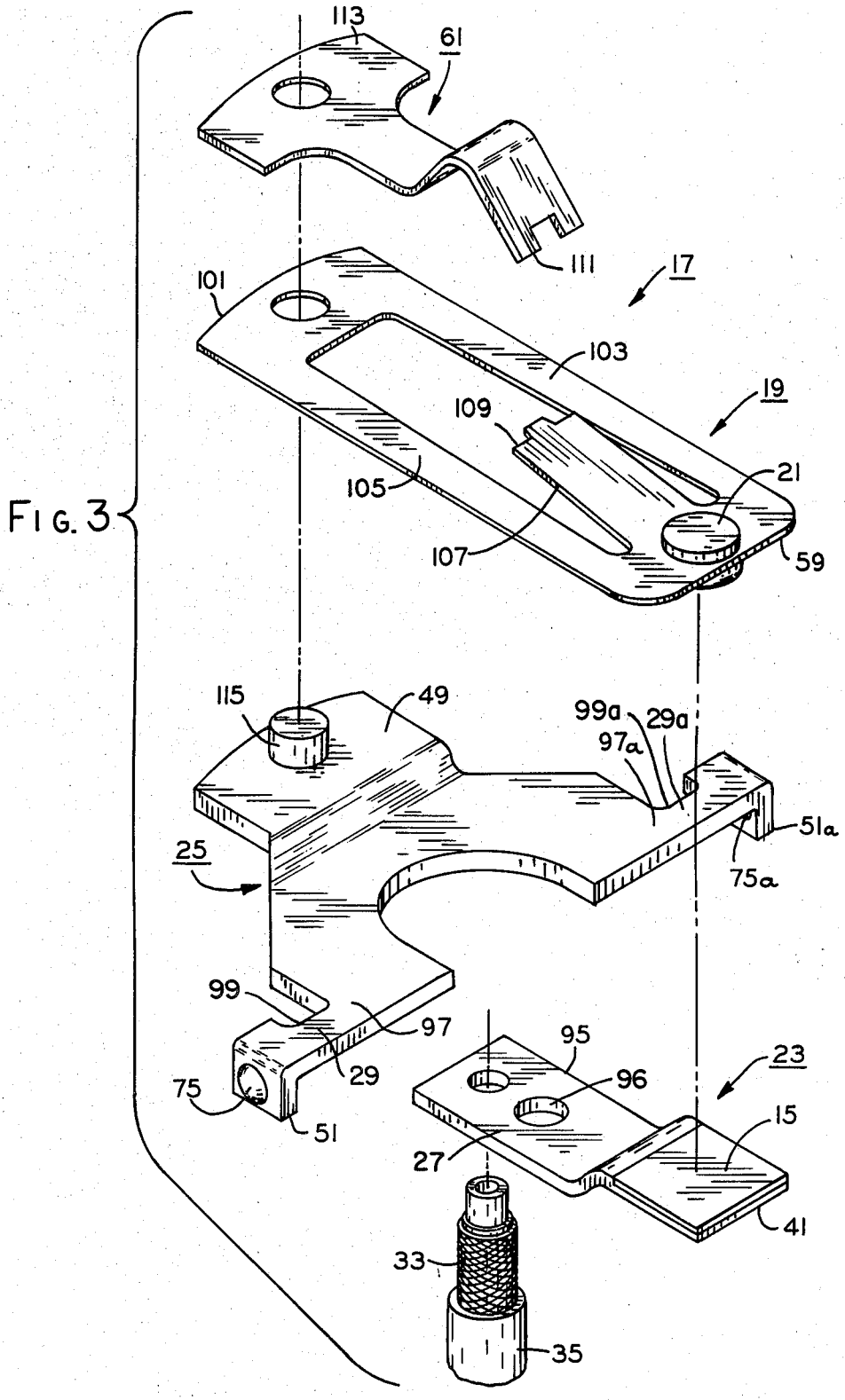
FIG. 3 is an exploded perspective view of a switch device, a contact and a pair of means for respectively supporting them as illustrated in the control device of FIG. 1.

Referring now to the drawings in general, there is illustrated a method of assembling a control device 11, such as a condition responsive or fluid pressure responsive electrical switch for instance (FIGS. 1–4). Control device 11 has a housing 13, a contact or contact means 15, and a switch or switch means 17 having a resilient, electrically conductive switch blade element 19 with another contact or contact means 21 thereon (FIGS. 1 and 3). A pair of means, such as supporting members 23, 25 for instance, for supporting contact 15 and switch 17 include yieldable or deformable sections, as indicated at 27 and 29, 29*a*, respectively, and means, such as a diaphragm or diaphragm means 31 for instance, is provided for actuating the switch to make and break contacts 15, 21 (FIGS. 1 and 3). In this method, supporting means or members 23, 25 and actuating means or diaphragm 31 are mounted or otherwise secured or arranged in assembly positions to housing 13, and contact 21 on switch blade 19 is engaged or otherwise positioned so as to be made with contact 15 in electrically conductive relation. Deformable section 27 of supporting member 23 is permanently deformed or otherwise yielded, and contact 15 is thereby located or otherwise adjustably moved to an adjusted position defining the magnitude of an altitude force F1 required to break contacts 15, 21 when switch 17 is actuated by diaphragm 31. Deformable sections 29, 29*a* of supporting member 25 are also permanently deformed or otherwise yielded, and switch blade 19 is thereby biased, urged or otherwise stressed into an adjusted position defining a constant force differential between the magnitude of the aforementioned altitude force F1 and that of another force F2 required to make or remake contacts 15, 21 when switch 17 is actuated by diaphragm 31 (FIGS. 1–3).

More particularly and with specific reference to FIGS. 1–4, supporting member 23, is secured or otherwise assembled by suitable means, such as staking or welding or the like for instance, to a mounting section or end portion 33 of a terminal or terminal post 35 and the terminal post may be inserted or otherwise extended through a generally central opening 37 in a dielectric base 39 of housing 13. A free end portion 41 of the supporting member to which contact 15 is secured is disposed generally in overlaying relation with a threaded opening 43 in the base adapted for threadedly receiving an adjusting screw 45. Of course during the insertion of terminal post 35 into central opening 37 of base 39, as discussed above, the terminal post and base may be secured together against displacement by suitable means, such as a press fit or the like for instance; however, it is contemplated that the terminal post may be secured in its assembled position to the base against displacement by other suitable means well known to the art within the scope of the invention so as to meet the objects thereof.

Either before, after of simultaneously with the above mentioned assembly of supporting member 23 and terminal post 35 and the securement of the terminal post with base 39, switch 17 may be assembled or otherwise mounted generally in cantilever fashion to a bridge section 49 of supporting member 25 by suitable means, such as staking or welding for instance. Thereafter and subsequent to the above discussed securement of terminal post 35 with base 39, a pair of depending flanges or flange means 51, 51*a* spaced from deformable sections 29, 29*a* on supporting member 25 are inserted or otherwise placed into a pair of generally opposite recesses or recess means 53, 53*a* provided therefor in base 39. With flanges 51, 51*a* of supporting member 25 so inserted into base recesses 53, 53*a*, bridge section 49 of the supporting member is disposed or otherwise arranged generally in overlaying relation with another threaded opening 55 in base 39 adapted for threadedly receiving another adjusting screw 57. Upon the above discussed assembly of supporting member 25 with base 39, contact 21 which is mounted on a free end or end portion 59 of switch blade 19 is engaged or otherwise arranged in electrical contacting relation with contact 15 on supporting member 23.

Figure 4:
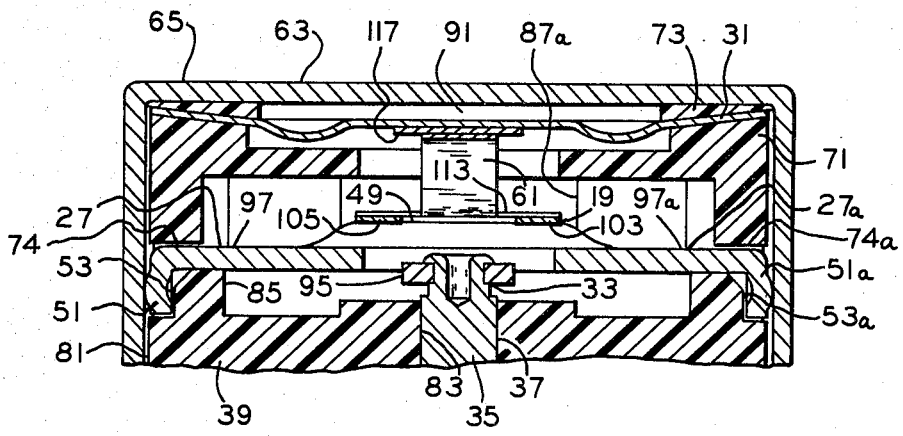
FIG. 4 is a partial sectional view taken along line 4—4 of FIG. 1.

Subsequent to the assembly of supporting means 25 with base 39, as discussed above, diaphragm 31 may be engaged or otherwise arranged in abutment with a snap-action toggle 61 of switch 17 and in sealing relation between an end wall 63 of an electrically conductive cover 65 and base 39 with a sidewall 67 of the cover extending generally about the base at least peripherally adjacent thereto so as to enclose supporting members 23, 25 and switch 17 within a chamber 69 defined between diaphragm 31, the base and the sidewall of the cover. Although diaphragm 31 is disclosed as being seated in sealing engagement between a pair of annular spacers 71, 73 which are, in turn, seated against base 39 and end wall 63 of cover 65, it is contemplated that the diaphragm may be sealably connected with the cover by suitable means, such as a peripheral weld bead or the like for instance, within the scope of the invention so as to meet at least some of the objects thereof. With base 39 and cover 65 associated in assembly relation so that sidewall 67 of the cover extends generally about a confronting peripheral part of the base, as discussed above, a pair of opposite surfaces 74, 74*a* on spacer 71 are arranged generally in spaced and/or overlaying relation with flanges 51, 51*a* when received in recesses 53, 53*a* thereby to capture the flanges therein, and the cover sidewall is interconnected in electrical conductive relation with a pair of nodes or abutting projections 75, 75*a* or the like, for instance, provided on flanges 51, 51*a* of supporting member 25 captured in recesses 53, 53*a* of the base, as best seen in FIG. 4. When base 39 and cover 65 are arranged in assembly relation with each other, as discussed above, sidewall 63 of cover 65 is secured by suitable means, such as a plurality of crimps 76 or the like for instance, to the base against displacement therefrom. While crimps 76 are disclosed for interconnecting base 39 and cover 65 against displacement, it is contemplated that such interconnection may be accomplished by other suitable means known to the art within the scope of the invention so as to meet at least some of the objects thereof.

Upon the above discussed interconnection of base 39 and cover 65, adjusting screw 45 may be adjustably or threadedly moved in threaded opening 43 of base 39 into driving or adjusting engagement with free end 41 of supporting member 23 in response to a manually applied adjusting force exerted by an operator using a suitable tool, such as a screw driver or the like for instance (not shown), on the adjusting screw. This adjusting force exerted on adjusting screw 45 is effective to permanently deform free end 41 of supporting member 23 about deformable section 27 thereof so as to move or otherwise displace contact 15 toward the adjusted position thereof defining the magnitude or preselected value of the aforementioned altitude or preselected force F1 to break contacts 15, 21 when switch 17 is actuated by diaphragm 31. Either before, after or simultaneously with the above discussed adjustable movement of adjusting screw 45, adjusting screw 57 may be adjustably or threadedly moved in threaded opening 55 of base 39 into driving or adjusting engagement with bridge section 49 of supporting member 25 in response to another manually applied force exerted by an operator using a suitable tool, such as a screw driver or the like for instance (not shown), on the adjusting screw. This another adjusting force exerted on adjusting screw 57 is effective to permanently deform deformable sections 29, 29*a* of supporting member 25 generally about flanges 51, 51*a* captured in base recesses 53, 53*a* and in response to such permanent deformation of deformable sections 29, 29*a* of the supporting member, switch blade 19 is biased toward an adjusted position with contact 21 thereon engaged with contact 15 in its adjusted position thereby to define the constant force differential between the aforementioned altitude or preselected force F1 and the aforementioned another or preselected force F2 to effect the making or remaking of contacts 15, 21 when switch 17 is actuated by diaphragm 31, as discussed in greater detail hereinafter.

With reference again in general to the drawings and recapitulating at least in part with respect to the foregoing, there is shown in one form of the invention control device 11 having housing 13 with chamber 69 therein (FIG. 1). Contact 15 is adapted for adjustable disposition in chamber 69, and switch or switch means 17 is operable generally in the chamber for making with the contact and breaking therefrom (FIG. 1). Supporting member 25 is adapted for adjustable disposition in chamber 69 and for mounting switch or switch means 17 therein with respect to contact 15, and means, such as diaphragm 31 for instance, is movable in housing 13 and engaged with the switch for effecting its operation (FIGS. 1 and 3). Adjusting means of screw 45 is adjustably movable in housing 13 for adjusting the disposition of contact 15 with respect to switch 17 so as to adjustably establish preselected force F1 at which the switch breaks from contact 15 in response to the movement of the switch means operation effecting means or diaphragm 31 (FIG. 1). Adjusting means or screw 57 is adjustably movable in housing 13 for adjusting the disposition of supporting member 25 mounting switch 17 with respect to contact 15 to adjustably establish the differential between the preselected force F1 and preselected force F2 at which switch 17 makes with contact 15 in response to the movement of diaphragm 31 (FIG. 1).

More particularly and with specific reference to FIGS. 1-4, control device 11 has a pair of housing members, such as base 39 and cover 65 for instance, and the base may be formed of any suitable dielectric material while the cover is formed from any suitable electrically conductive metallic material. Base 39 has a plurality of walls or wall means including a pair of opposite end walls 77, 79 interposed between a sidewall 81, and a pair of stepped bores or partial bores 83, 85 in the base intersect with the opposite end walls thereof, respectively, with the smaller stepped bore 83 comprising central opening 37. Opposite recesses 53, 53*a* are provided in end wall 77 of base 39, and a pair of generally opposite slots 87, 87*a* are also provided in end wall 77 of base 39 so as to communicate generally between larger stepped bore 85 and sidewall 81 of the base, respectively, with spacer 71 being seated on upper end wall 77 of the base. Threaded openings 43, 55 in base 39 extend between lower end wall 79 thereof and slots 87, 87*a*, and at least one pressure fluid passage or port 89 is provided through end wall 63 of cover 65 communicating with an expansible pressure fluid chamber 91 defined in the cover between diaphragm 31 and the cover end wall.

Terminal post 35 is secured in smaller stepped bore 83 of base 39 against displacement therefrom, as previously mentioned, and mounting section or end 33 of the terminal post extends into larger stepped bore 85 of the base while an electrical extension section 93 of the terminal post is exposed exteriorly of housing 13 for association with a quick-connect electrical fitting or coupling of a type known to the art (not shown). Supporting member or terminal extension 23 has an end or end portion 95 opposite free end 41 thereof which is secured to mounting section 33 of terminal post 35, and the free end of the terminal extension extends into slot 87 in end wall 77 of base 39 into overlaying relation with threaded opening 43 in the base. It may be noted that a weakening opening 96 is provided through terminal extension 23 between mounted end 95 and free end 41 thereof so as to define deformable section 27 in the terminal extension; however, while weakening opening 96 is shown for purposes of disclosure, it is contemplated that other means, such as grooves, notches or other section reducing configurations or the like for instance, for defining deformable section 27 may be utilized within the scope of the invention so as to meet at least some of the objects thereof. When flanges 51, 51*a* of supporting member 25 are positioned in recesses 53, 53*a* therefor in base 39, as previously discussed, bridge section 49 of the supporting member extends into slot 87*a* in end wall 77 of base 39 into overlaying relation with threaded opening 55, and a pair of arms 97, 97*a* are provided on the supporting member between the bridge section thereof and the flanges, respectively. It may be noted that arms 97, 97*a* are notched at 99, 99*a* thereby to define deformable sections 29, 29*a* in the arms at least generally adjacent flanges 51, 51*a*, respectively. While notches 99, 99*a* are illustrated herein for purposes of disclosure as being generally adjacent flanges 51, 51*a* for defining deformable sections 29, 29*a* in supporting member 35, it is contemplated that other means, such as openings, grooves or other section reducing configurations may be provided at any location in supporting member 25 spaced from flanges 51, 51*a* for defining such deformable sections within the scope of the invention so as to meet at least some of the objects thereof. Furthermore, it is also contemplated that arms 97, 97*a* may be provided with various shapes other than that disclosed herein for purposes of illustration within the scope of the invention so as to meet at least some of the objects thereof.

Switch blade 19 of switch 17 includes a mounting end 101 generally opposite free end 59 thereof, and a pair of spaced apart, generally planar legs 103, 105 are integrally formed between the mounting and free ends. A tongue 107 is integrally formed on free end 59 of switch blade 19 extending generally in a direction toward mounting end 101 thereof, and a pivot end 109 is provided on the tongue. Toggle or spring blade 61 has another pivot end 111 pivotally engaged with pivot end 109 of switch blade tongue 107 and another mounting end 113 generally opposite pivot end 111. Toggle mounting end 113 is arranged generally in overlaying relation in abutment with mounting end 101 of switch blade 19 on bridge section 49 of supporting member 25, and mounting ends 101, 113 are secured to the bridge section by suitable means, such as a rivet 115 or the like for instance, integrally formed with the bridge section. With toggle 61 so pivotally engaged with tongue 107 of switch blade 19 so as to comprise toggle means of switch 17, it may be noted that the toggle urges the switch blade in a direction so as to make contact 21 on switch blade free end 59 with contact 15 on terminal extension 23. Furthermore, it may also be noted that toggle 61 may be abutted with lubrication means, such as a piece of Teflon tape 117 or other lubricant or the like for instance if desired, for lubrication purposes on the underside of diaphragm 31 which, as previously mentioned, is movably mounted with respect to cover 65 so as to be arranged in driving engagement with the toggle to effect the operation or actuation of switch 17. While switch 17 has been described and illustrated herein for the purposes of disclosure, it is contemplated that other switches having other configurations, component parts and different switching actions may be utilized within the scope of the invention so as to meet at least some of the objects thereof.

Operation

In the operation of control device 11, assume that deformable sections 27 and 29, **29*a* of terminal extension 23 and supporting member 25 have been permanently deformed, as previously discussed hereinbefore, and also assume that the control device is interconnected in an electrical circuit (not shown). Thus, with the component parts of control device 11 disposed as described above and as illustrated in the drawings, current may flow, in one direction for instance, through the control device from terminal post 35 through terminal extensions 23, closed contacts 15, 21 switch blade 19 and bridge 49, arms 97, 97*a*, flanges 51, 51*a* and nodes 75, 75*a* of supporting member 25 to cover 65**.

In the event of the occurrence of a fluid pressure at control port 89 and in pressure fluid chamber 91 of control device 11, the fluid pressure acts on the effective area of diaphragm 31 to create an actuating force acting to effect the displacement or driving movement of the diaphragm downwardly (as best seen in FIG. 1) against toggle 61 of switch 17. When the fluid pressure at control port 89 attains a magnitude increasing the actuating force to the preselected value of the aforementioned altitude force F1, diaphragm 31 is driven against toggle 61 of switch 17 so as to pivotally move tongue 107 of switch blade 19 downwardly past the plane of switch blade legs 103, 105 which, of course, effects the snap-action movement of the switch blade in a direction breaking or disengaging its contact 21 from contact 15 of terminal extension 23 thereby to interrupt or break the electrical circuit through the control device. Upon the actuation of switch 17 to its switching state breaking its contact 21 from contact 15, contact 21 is abutted with spacer 71 thereby to limit the breaking movement of switch blade 19.

When the fluid pressure at control port 89 is reduced the actuating so as to correspondingly reduce force by the aforementioned constant force differential to another preselected value less than the preselected value at which switch 17 was actuated, diaphragm 31 moves upwardly (as best seen in FIG. 1) in response to such reduction of the fluid pressure at the control post thereby to effect the toggling snap-action return movement of switch blade 19 to its at-rest position remaking or reengaging its contact 21 with contact 15 on terminal extension 23. Thus, with contacts 15, 21 again made, the electrical circuit through control device 11 is once again completed.

From the foregoing, it is now apparent that a novel control device 11 has been presented meeting the objects and advantageous features set out hereinbefore, as well as others, and that modifications as to the precise configurations, shapes, details and connections of such control device may be made by those having ordinary skill in the art without departing from the spirit of the invention or the scope thereof as set out by the claims which follow.

What I claim as new and desire to secure by Letters Patent of the United States is:

1. A control device including:

a pair of housing members;

one of said housing members being formed of a dielectric material and including a pair of opposite end walls, a pair of stepped bores intersecting with said opposite end walls, respectively, a pair of sets of generally opposite recesses in one of said opposite end walls, respectively, and a pair of threaded openings intersecting with the other of said opposite end walls and one of said recess sets, respectively;

the other of said housing members being formed of an electrically conductive material and including a sidewall extending generally in confronting relation about said one housing member and secured thereto, a base wall integral with said sidewall and extending over said one opposite end wall of said one housing member, and at least one pressure fluid passage extending through said base wall;

a pair of generally annular spacers seated on said one opposite end wall of said one housing member and said base wall of said other housing member, respectively;

a diaphragm seated between said spacers and said diaphragm defining with said other housing member a chamber in communication with said at least one pressure fluid passage in said base wall of said other housing member;

a terminal extending through the smaller of said stepped bores of said one housing member and mounted thereto, said terminal having a mounting section within said larger stepped bore of said one housing member and an electrical connection section extending exteriorly thereof;

a terminal extension having a pair of opposite end portions with a first deformable section therebetween, one of said opposite end portions being secured to said mounting section of said terminal and the other of said opposite end portions extending into one of said opposite recesses in said one recess set in said one opposite end wall of said one housing member so as to be disposed at least adjacent one of said threaded openings in said one housing member, and a first contact on said terminal extension at least adjacent said other opposite end portion thereof;

a supporting member including a bridge section extending into the other of said opposite recesses of said one recess set in said one opposite end wall of said one housing member so as to be disposed at least adjacent the other of said threaded openings in said one housing member, a pair of arms integral with said bridge section and spanning a part of said larger stepped bore generally between the other of said recess sets in said one opposite end wall of said one housing member, respectively, a pair of depending flanges on said arms received in said opposite recesses of said other recess sets in said one opposite end wall of said one housing member, respectively, a pair of means on said flanges for abutment in electrical conductive relation with said sidewall of said other housing member when said flanges are received in said opposite recesses of said other recess set, respectively, and a pair of second deformable sections in said arms and spaced from said flanges, respectively;

switch means adapted for actuation in response to movement of said diaphragm upon the occurrence of fluid pressure in excess of a preselected value at said at least one pressure fluid passage and in said chamber acting on said diaphragm, said switch means including a resilient electrically conductive switch blade having a first mounting end secured to said bridge section of said supporting member and a free end portion generally opposite said first mounting end extending into said one opposite recess of said one recess set in said one opposite end wall of said one housing member, a second contact of said free end portion of said switch blade, a tongue on said free end portion of said switch blade extending therefrom generally in a direction toward said first mounting end thereof and having a first pivoted end, a spring blade engaged with said diaphragm and having a second mounting end secured to said bridge section of said supporting member and a second pivot end generally opposite said second mounting end pivotally engaged with said first pivot end on said tongue of said switch blade so as to urge said second contact thereon toward engagement with said first contact on said other opposite end portion of said terminal extension, said spring blade being conjointly movable with said diaphragm in response to the fluid pressure in excess of the preselected value acting thereon to drive said tongue in a direction to effect snap action movement of said switch blade toward a position disengaging said second contact from said first contact;

a first adjusting screw threadedly received in said one threaded opening in said one housing member so as to engage with said one opposite end portion of said terminal extension, said first adjusting screw being adjustably movable in response to a first manual adjusting force exerted thereon to effect deformation of said first deformable section of said terminal extension and adjustably move said first and second contacts into an adjusted position defining the force of the preselected value of the fluid pressure acting on said diaphragm upon the actuation of said switch means to effect the disengagement of said second contact from said first contact;

a second adjusting screw threadedly received in said other threaded opening in said one housing member so as to engage with said bridge section of said supporting member, said second adjusting screw being adjustably movable in response to a second manually applied force exerted thereon to effect the deformation of said second deformable sections generally about said flanges of said supporting member received in said opposite recesses of said other recess set in said one opposite end wall of said one housing member so as to stress said switch blade urging said second contact thereon in a direction toward its engagement with said first contact thereby to adjust a differential between the force of the first named preselected value acting on said diaphragm upon the actuation of said switch means to effect the disengagement of said second contact from said first contact and the force of another preselected value of the fluid pressure acting on said diaphragm to actuate said switch means and effect the reengagement of said second contact with said first contact.

2. A control device comprising:

a housing having a chamber therein;

contact means adapted for adjustable disposition into an adjusted position within said chamber;

means mounted to said housing for supporting said contact means, said supporting means including means spaced from said contact means within said chamber and adapted for permanent deformation, and means exteriorly of said chamber adapted for electrical connection;

switch means adapted for adjustable disposition into another adjusted position in said chamber and operable generally for making with said contact means and breaking therefrom;

another means mounted to said housing within said chamber for supporting said switch means and including at least another means adapted for permanent deformation;

means movable in said housing for effecting the operation of said switch means;

means adjustably movable in said housing and engaged with said first named supporting means within said chamber for exerting an adjusting force thereon to permanently deform said first named permanent deformation means and effect the adjustable disposition of said contact means to the first named adjusted position thereof; and another means adjustably movable in said housing and engaged with said another supporting means within said chamber for exerting another adjusting force thereon to permanently deform said at least another permanent deformation means and effect the adjustable disposition of said switch means to the another adjusted position thereof.

3. A control device as set forth in claim 2 wherein said first named supporting means comprises terminal extension means within said chamber, a free end portion on said terminal extension means mounting said contact means and adapted for engagement with said first named adjusting means, and said first named permanent deformation means comprising a permanently deformable section on said terminal extension means and associated with said free end portion, said permanently deformable section being permanently deformed when the first named adjusting force is exerted on said free end portion in response to the adjustable movement of said first named adjusting means to effect the adjustable disposition of said contact means to the first named adjusted position thereof.

4. A control device as set forth in claim 2 wherein said another supporting means includes a pair of generally oppositely extending arms mounted to said housing within said chamber, and at least one of said arms having a permanently deformable section comprising said another permanent deformation means, said permanently deformable section being permanently deformed when the another adjusting force is exerted on said another supporting means in response to the adjustable movement of said another adjusting means to effect the adjustable disposition of said switch means to the another adjusted position thereof.

5. A control device as set forth in claim 2 wherein said switch means operation effecting means includes diaphragm means engaged with said switch means and adapted for movement in response to fluid pressure supplied thereto to effect the operation of the switch means.

6. A control device as set forth in claim 2 wherein said switch means includes means for effecting snap action movement of said switch means to make with said contact means and to break therefrom.

7. A control device as set forth in claim 2 wherein said first named adjusting means and said another adjusting means comprise a pair of adjusting screws threadedly received in said housing and engaged with said first named supporting means and said another supporting means, respectively.

8. A control device comprising:

a housing having a chamber therein;

a terminal post mounted to said housing including a mounting section within said chamber, and an electrical connection section extending exteriorly of said chamber;

a terminal extension within said chamber including a pair of opposite end portions, a permanently deformable section in said terminal extension between said opposite end portions, one of said opposite end portions being secured in mounting engagement with said mounting section of said terminal post, and contact means on the other of said opposite ends of said terminal extension adapted for adjustable disposition in an adjusted position in said chamber;

switch means adapted for adjustable disposition in another adjusted position in said chamber and operable generally for making with said contact means and breaking therefrom;

means movable in said housing for effecting the operation of said switch means;

means mounted within said chamber for supporting said switch means therein and including at least another permanently deformable section; and a pair of adjustng means engaged with said other end portion of said terminal extension and said supporting means and adjustably movable in said housing in response to applied adjusting forces for permanently deforming said first named permanently deformable section and said at least another permanently deformable section to effect the adjustable disposition of said contact means in the first named adjusted position and said switch means in the another adjusted position thereof, respectively.

9. A control device as set forth in claim 7 wherein said another supporting means comprises at least one arm position mounted to said housing within said chamber and connected with said switch means, and said at least one arm portion including said at least another permanently deformable section.

10. A control device as set forth in claim 7 wherein said operation effecting means comprises a fluid pressure responsive diaphragm defining a wall of said chamber and connected with said switch means.

11. A control device as set forth in claim 7 wherein said adjusting means comprise a pair of adjusting screws threadedly received in said housing, respectively.

12. A control device comprising:

a housing including a dielectric base and an electrically conductive cover defining therebetween a chamber, and a pair of recesses in said base within said chamber;

contact means adapted for adjustable disposition in an adjusted position in said chamber;

means mounted to said base for supporting said contact means including a yieldable section;

switch means adapted for adjustable disposition in another adjusted position in said chamber and operable generally for making with said contact means and breaking therefrom;

another means mounted to said base for supporting said switch means within said chamber, said another supporting means including a pair of generally opposite arms spanning said chamber and connected with said switch means, respectively, a pair of flanges on said arms seated in engagement with said recesses of said base and engaged in electrical conductive relation with said cover, respectively, and at least another yieldable section in at least one of said arm portions; and a pair of adjusting means engaged with said first named supporting means and said another supporting means and adjustably movable in said base in response to an applied adjusting force for yielding said first named yieldable section to effect the adjustable disposition of said contact means to the first named adjusted position thereof and for yielding said at least another yieldable section generally about the seating engagement of at least one of said depending flanges and at least one of said recesses to effect the adjustable disposition of said switch means to the another adjusted position thereof, respectively.

13. A control device comprising:

a housing;

means in said housing and operable generally for switching between a pair of switching modes;

means movable in said housing for effecting the operation of said switching means between the switching modes thereof;

contact means for engagement with said switching means when said switching means is in one of the switching modes thereof;

a pair of means arranged in said housing for supporting said switching means and said contact means, respectively, each of said supporting means including at least one permanently deformable section; and a pair of adjusting means adjustably movable in said housing for engaging said supporting means and effecting permanent deformation of said at least one permanently deformable sections of said supporting means when said switching means is in the one switching mode thereof, respectively, the permanent deformation of said at least one permanently deformable section of one of said supporting means defining a predetermined force at which said switching means is operable from the one switching mode to the other of the switching modes thereof in response to the movement of said switching means operation effecting means and the permanent deformation of said at least one permanently deformable section of the other of said supporting means defining a differential between the first named predetermined force and another predetermined force at which said switching means is operable from the other switching mode to the one switching mode thereof in response to the movement of the switching means operation effecting means.

14. A control device comprising:

a housing;

a pair of supporting members mounted in said housing, respectively, and each of said supporting members including at least one deformable section;

a contact mounted to one of said supporting members;

means mounted to the other of said supporting members and operable generally with snap action for switching between a pair of switching positions, said switching means including toggle means for effecting the snap action operation thereof and said switching means in one of its switching positions being engaged with said contact;

diaphragm means movable in said housing for effecting the snap action operation of said switching means between the switching position thereof and defining with said housing expansible chamber means adapted for subjection to fluid pressure, said diaphragm means including a portion within said expansible chamber means and an opposite portion in abutting engagement with said toggle means of said switching means; and a pair of adjusting means manually movable in said housing for engaging said supporting members and effecting the permanent deformation of said at least one permanently deformable sections of said supporting members when said switching means is in the one switching position thereof engaged with said contact, respectively, the permanent deformation of said at least one permanently deformable section of said other supporting member defining a predetermined force at which said switching means is operable with snap action from the one switching position to the other of the switching positions thereof disengaged from said contact upon the movement of said diaphragm means and the permanent deformation of said at least one deformable section of said one supporting member defining another predetermined force at which said switching means is returned with snap action from the other switching position to the one switching position thereof upon further movement of said diaphragm means.

* * * * *